US006514162B1

(12) United States Patent
Karellas

(10) Patent No.: US 6,514,162 B1
(45) Date of Patent: Feb. 4, 2003

(54) HOCKEY TRAINING TOOL

(76) Inventor: John J. Karellas, 7059 N. Ottawa, Chicago, IL (US) 60631

( * ) Notice: Subject to any disclaimer, the term of this patent is extended or adjusted under 35 U.S.C. 154(b) by 0 days.

(21) Appl. No.: 09/707,812

(22) Filed: Nov. 7, 2000

(51) Int. Cl.[7] ..... A63B 69/00; A63B 67/00; F41B 7/00; F41A 19/00; F41F 1/00

(52) U.S. Cl. ..... 473/446; 473/471; 124/6; 124/16; 124/32; 124/46; 124/51.1

(58) Field of Search ..... 473/131–149, 473/417–460, 386–394; 273/108.1, 108.31, 405; 124/1, 6, 7, 16, 49, 32, 79, 46, 51.1

(56) References Cited

U.S. PATENT DOCUMENTS 3,838,677 A * 10/1974 Alvares ..... 124/16
3,876,201 A * 4/1975 King ..... 124/4
3,955,815 A 5/1976 Deschesnes
4,070,017 A 1/1978 Lombardi
4,607,842 A 8/1986 Daoust
4,815,744 A * 3/1989 Diamandis ..... 473/136
4,995,374 A * 2/1991 Black ..... 124/32
5,050,575 A * 9/1991 Killion ..... 124/49
5,069,451 A 12/1991 Martens et al.
5,370,386 A 12/1994 Parks
5,470,067 A 11/1995 Diresta
5,672,129 A 9/1997 Fisher et al.
5,846,144 A 12/1998 Bothers

* cited by examiner

*Primary Examiner*—Paul T. Sewell
*Assistant Examiner*—Mitra Aryanpour
(74) *Attorney, Agent, or Firm*—John D. Gugliotta; P. Jeff Martin

(57) ABSTRACT

The present invention relates to a hockey training device. In its broadest context, the present invention includes a hollow vertical housing with both a loading end and a discharge end. The intermediate extend of the housing is adapted to store a number of hockey pucks. A discharge device, such as a solenoid actuated plunger or spring urged driving bar, is employed in forcing pucks out through the discharge end of the housing. In this manner, the device can be used in driving pucks, one at a time, vertically and flat across the ice.

1 Claim, 2 Drawing Sheets

HOCKEY TRAINING TOOL

RELATED APPLICATIONS

The present invention was first described in Disclosure Document Number 476,639 filed on Jul. 7, 2000. There are no previously filed, nor currently any co-pending applications, anywhere in the world.

BACKGROUND OF THE INVENTION

1. Field of the Invention

The present invention relates generally to practice and training devices for games using tangible projectiles and, more particularly, to a spring discharging device for hockey pucks specifically adapted for lateral discharge of the puck.

2. Description of the Related Art

In the related art, there are a great deal of sports which utilize automated training aids. Baseball uses automatic pitching machines to simulate actual pitching to aid in batting or catching. Tennis uses automatic serving machines to simulate tennis serves and allow the practicing player to return the shots.

These automatic machines provide several benefits. First, the user can practice by themselves without the use of another player or coach. Second, the repetitive, controlled dispensing allows the user to concentrate on improving certain aspects of their play without worrying about getting a good pitch or serve. Third, the storage capacity allows for long training times without refilling the hopper.

However, one sport which does not have the luxury of automatic training machines is hockey. A typical hockey player could vastly improve their skills if repeated, unattended dispensing of hockey pucks could occur. A search of the prior art did not disclose any patents that read directly on the claims of the instant invention; however, the following references were considered related.

The following patents disclose a detachable hockey puck dispensing and holding apparatus.

U.S. Pat. No. 5,846,144 issued in the name of Bothers

U.S. Pat. No. 5,470,067 issued in the name of Diresta

U.S. Pat. No. 5,370,386 issued in the name of Parks

U.S. Pat. No. 5,069,451 issued in the name of Martens et al.

U.S. Pat. No. 4,070,017 issued in the name of Lombardi

U.S. Pat. No. 5,672,129 issued in the name of Fisheret al. describes a toy hockey game with hook-and-loop material to attach the projectile to the stick.

U.S. Pat. No. 4,607,842 issued in the name of Daoust discloses an exercising apparatus for hockey players to practice shots.

U.S. Pat. No. 3,955,815 issued in the name of Deschesnes describes a hockey training device with a puck connected to a resilient member restricting motion over playing surface.

Of considerable relevance is U.S. Pat. No. 5,846,144 issued in the name of Bothers. Although some feature of the present invention are adaptable to that disclosed in Bothers, the present invention provides a spring discharging device for hockey pucks specifically adapted for lateral discharge of the puck.

Consequently, there exists a need for a means by which hockey players can be afforded the luxury of a device which automatically places hockey pucks in play for the purposes of practicing.

SUMMARY OF THE INVENTION

It is another object of the present invention to provide a device which will automatically places hockey pucks in play for the purposes of practicing.

It is a further object of the present invention to provide a puck storage and discharging device.

Briefly described according to one embodiment of the present invention, a hockey training tool is an apparatus to aid in training of hockey players. The invention consists of a large storage tube in which hockey pucks are stored in a horizontal position. The pucks pass down to a dispensing mechanism which launches the puck outward to the practicing player through a dispensing slot. It is envisioned that the dispensing mechanism would be adjustable in speed and subsequent force so that it would be suitable for all types and levels of players. An adjustable timing mechanism provides for a suitable interval between the hockey pucks. The invention is suited for sitting directly on the ice and is lightweight for ease of transportation and setup.

The use of the present invention provides a needed practice tool for all hockey players whether practicing as an individual or a team.

In accordance with a preferred embodiment, the present invention teaches and reinforces fundamentals of hockey, teaches new students basic actions, reinforces good techniques for seasoned players, and offers active reinforcement in a manner that allows a teacher or coach to offer immediate tips or hints.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The present invention relates to a hockey puck training device storage and delivery system. In its broadest context, the present invention includes a hollow vertical housing with both a loading end and a discharge end. The intermediate extend of the housing is adapted to store a number of hockey pucks. A discharge device, such as a spring urged driving mechanism or solenoid actuated plunger, is employed in forcing pucks out through the discharge end of the housing in a flat, horizontally accelerated manner. In this manner, the device can be used to automatically place hockey pucks in play for the purposes of practicing.

The various components of the present invention, and the manner in which they interrelate, will be described in greater detail hereinafter.

1. Detailed Description of the Figures

Figure 1:
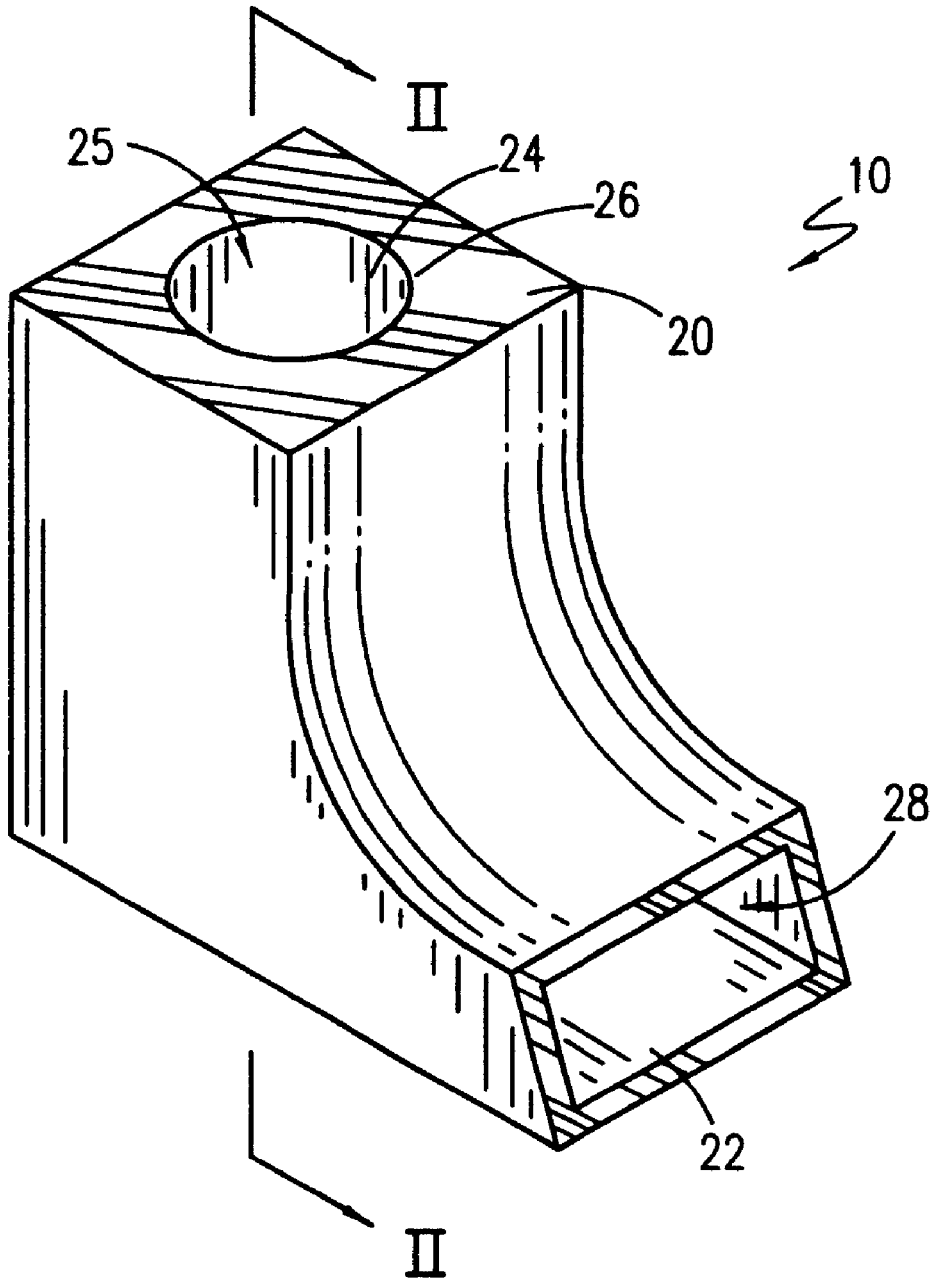
FIG. 1 is a perspective view of the hockey training tool for storing and discharging hockey pucks according to the preferred embodiment of the present invention.

With reference to FIG. 1, a hockey training tool 10 according to the present invention is illustrated. The vertical housing 20 has a discharge end 22 and a loading end 24 and an intermediate hollow extent therebetween. A number of hockey pucks are adapted to be stored, and travel within, the interior guide shaft 25 formed within the loading end 24 of the housing 20. A circular loading aperture 26 is formed within the loading end 24 of the housing for use in placing hockey pucks within the housing 20. It is anticipated that a plurality of hockey pucks would be aligned vertically, and held in place by the force of gravity, with the bottommost puck being held in a "firing" position until forced out by the weight of the pucks above as will be described in greater detail below.

Figure 2:
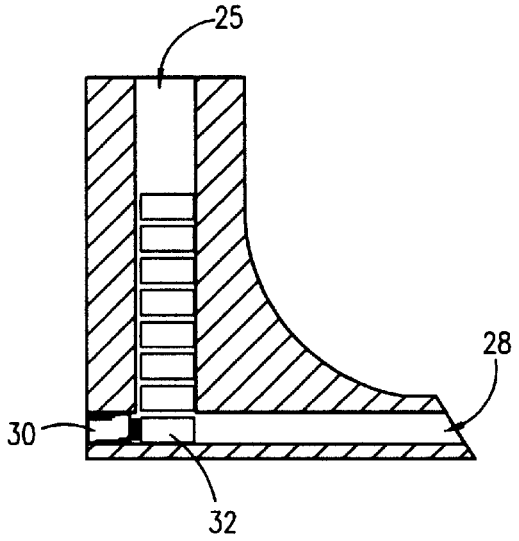
FIG. 2 is a cross sectional side elevational view taken along line II—II of FIG. 1.

The housing 20 also includes a discharge aperture 28 which is formed within the discharge end 22 of the housing 20. With reference to FIG. 2, a puck discharge means 30 is secured to the housing 20 at the rear of the housing 20, behind the interior guide shaft 25 and opposite the discharge end 22 of the housing 20. The puck discharge means 30 is designed to drive the lowermost puck within the shaft 25, herein noted as 32, out through the discharge aperture 28 of the discharge end 22 in a flat, horizontally accelerated manner. In this manner, the device can be used to automatically place hockey pucks in play for the purposes of practicing.

Figure 3:
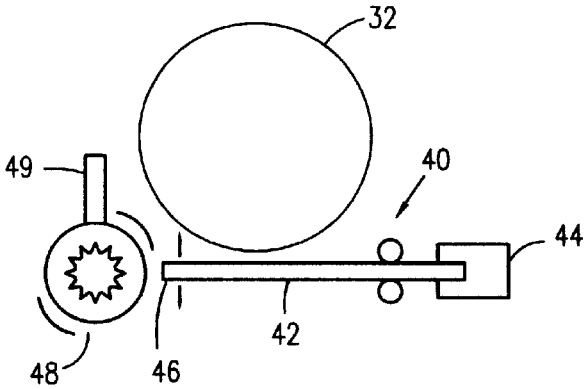
FIG. 3 is a top plan view of a puck discharge means according to a first embodiment for use with the present invention.

Referring now to FIG. 3, a spring drive mechanism 40 is shown for driving the lowermost puck 32. The mechanism 40 includes spring urged driving bar 42 which is adapted to cooperate with the discharge aperture 28 of the discharge end 22. More specifically, the bar 42 is of sufficient overall width and length such as to impact and contact only the lowermost puck 32 and not any other puck above within the interior guide shaft 25. Once the lowermost puck 32 is impacted and accelerated out of the discharge aperture 28, the pucks above will drop down into place, thereby presenting the next puck into the proper position for discharge.

The force of the driving bar 42 is sufficient to overcome the weight within the interior guide shaft 25 above. In this manner, the driving bar 42 dislodges the puck from its initial position over the discharge aperture 28. The driving bar 42 is anticipated as being a metal or rigid member affixed at one end to an anchoring position 44. The opposite end 46 can then be articulated away from the puck 32 in order to generate the necessary spring urged driving force. The end 46 can be activated by way of a manual gripping tab or, as shown herein, by an rotary electrical driving motor 48. The motor 48 is geared to rotate slowly and with sufficient torque such that an actuation tab 49, which is radially disposed and rotated about the motor 48 impinges against the end 46, a similar articulation of the bar 42 away from the puck 32 can be accomplished in order to generate the necessary spring urged driving force. In this manner, a timed discharge of pucks can be obtained depending upon the number and spacing of actuation tabs.

Figure 4:
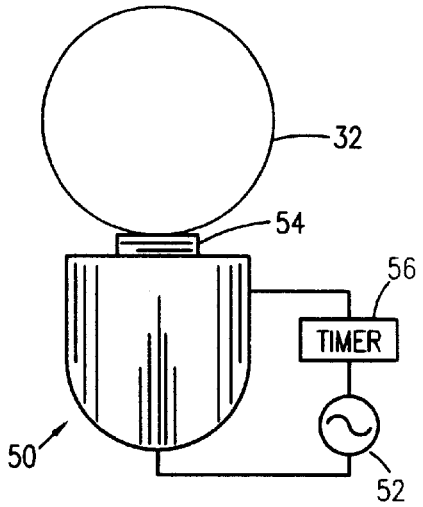
FIG. 4 is a top plan view of a puck discharge means according to a second embodiment for use with the present invention.

Referring now to FIG. 4, a solenoid device 50 can be electrically powered via an external source of power 52 or a battery and/or air. The solenoid 50 includes an internally located plunger 54 which is adapted to cooperate with the discharge aperture 28 of the discharge end 22. More specifically, the plunger 54 is of sufficient overall width such as to impact and contact only the lowermost puck 32 and not any other puck above within the interior guide shaft 25. Once the lowermost puck 32 is impacted and accelerated out of the discharge aperture 28, the pucks above will drop down into place, thereby presenting the next puck into the proper position for discharge.

The force of the plunger 54 is sufficient to overcome the weight within the interior guide shaft 25 above. In this manner, the plunger 54 dislodges the puck from its initial position over the discharge aperture 28. The solenoid plunger 54 can be activated by way of a switch associated with the solenoid. However, in the preferred embodiment, a random timer 56 is associated with the solenoid such that the plunger will be operated at a random interval.

2. Operation of the Preferred Embodiment

To use the present invention, the housing 20 is suited for sitting directly on the ice and is lightweight for ease of transportation and setup. The pucks pass down to a dispensing mechanism which launches the puck outward to the practicing player through a dispensing slot. The use of the present invention provides a needed practice tool for all hockey players whether practicing as an individual or a team.

In accordance with a preferred embodiment, the present invention teaches and reinforces fundamentals of hockey, teaches new students basic actions, reinforces good techniques for seasoned players, and offers active reinforcement in a manner that allows a teacher or coach to offer immediate tips or hints.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A hockey puck storage and delivery device comprising in combination:

a vertical housing having a discharge end and a loading end and an intermediate hollow extent therebetween wherein a plurality of stacked, conventional hockey pucks are aligned vertically and can be stored, and hold in place by force of gravity with a lowermost puck held in a firing position;

an interior guide shaft formed within said loading end of said housing;

a circular loading aperture formed within said loading end of said housing for use in placing hockey pucks within the housing;

a discharge aperture formed within the discharge end of the housing; and a spring drive mechanism secured to said housing at a rear of said housing behind said interior guide shaft and opposite said discharge end wherein once said lowermost puck is impacted and accelerated out of said discharge aperture a puck above will drop down into place thereby presenting the next puck into the proper position for discharge, said spring drive mechanism is designed to drive said lowermost puck within the shaft out through said discharge aperture of said discharge end in a flat, horizontally accelerated manner, said spring drive mechanism includes a spring urged driving bar which is adapted to cooperate with said discharge aperture of said discharge end, wherein said spring urged driving bar is of sufficient overall width and length such as to impact and contact only said lowermost puck and not any other puck above within said interior guide shaft, said spring urged driving bar form a rigid member affixed at one end to an anchoring position such that an opposite end can then be articulated away from a puck in order to generate a necessary spring urged driving force, wherein said spring urged driving force of said spring urged driving bar is sufficient to overcome the force of gravity within said interior guide shaft, and wherein said spring urged driving bar dislodges said lowermost puck from an initial position of said lowermost puck through said discharge aperture, and wherein said spring urged driving bar is activated by a rotary electrical driving motor, said motor geared to rotate slowly and with sufficient torque such that an actuation tab which is radially disposed and rotated about said motor such as to impinge against said opposite end of said spring urged driving bar.

* * * * *